US005854535A

United States Patent [19]

Hohlfeld et al.

[11] Patent Number: 5,854,535

[45] Date of Patent: Dec. 29, 1998

[54] METAL HALIDE DISCHARGE LAMP WITH A QUARTZ DISCHARGE VESSEL AND AN OUTER UV RADIATION ABSORBENT ENVELOPE

[75] Inventors: Andreas Hohlfeld; Dirk Hoffmann, both of Berlin, Germany; Akihiro Kanda, Ogasa-gun; Katsuya Otani, Yamato, both of Japan

[73] Assignee: Patent-Treuhand-Gesellschaft für elektrische Glühlampen mbH, Munich, Germany

[21] Appl. No.: 666,398

[22] PCT Filed: Dec. 20, 1994

[86] PCT No.: PCT/EP94/04233

§ 371 Date: Jun. 25, 1996

§ 102(e) Date: Jun. 25, 1996

[87] PCT Pub. No.: WO95/19639

PCT Pub. Date: Jul. 20, 1995

[30] Foreign Application Priority Data

Jan. 18, 1994 [EP] European Pat. Off. ..... 94100669

[51] Int. Cl.[6] ..... H01J 61/30

[52] U.S. Cl. ..... 313/636; 313/112; 313/25; 313/570

[58] Field of Search ..... 313/636, 570, 313/571, 25, 112, 634, 635, 567–569, 572–573, 638

[56] References Cited

U.S. PATENT DOCUMENTS

| | | | |
|---|---|---|---|
| 3,662,203 | 5/1972 | Kuhl et al. | 313/112 |
| 4,717,852 | 1/1988 | Dobrusskin et al. | 313/25 |
| 4,825,127 | 4/1989 | Krasko et al. | 313/638 |
| 5,057,743 | 10/1991 | Krasko et al. | 313/639 |
| 5,111,104 | 5/1992 | Hunter | 313/634 |
| 5,196,759 | 3/1993 | Parham et al. | 313/112 |

*Primary Examiner*—Jay M. Patidar
*Attorney, Agent, or Firm*—Frishauf, Holtz, Goodman, Langer & Chick, P.C.

[57] ABSTRACT

A metal halide lamp has an outer envelope (3, 23) of quartz glass which surrounds a discharge vessel (2, 22) of quartz glass. The discharge vessel (2, 22) gas-tightly retains an ionizable fill which includes sodium. In order to avoid loss of sodium from the discharge vessel (2, 22) due to UV radiation impinging upon current supply wires (8, 9, 28, 29) extending from the discharge vessel (2, 22) within and into the outer envelope (3, 23), the quartz glass of the outer envelope is doped with materials absorbing UV radiation, preferably cerium aluminate and titanium oxide; the outer envelope is spaced from the discharge vessel by at most 5 mm, the sodium content in the ionizable fill is at most 0.7 $mg^3$ of the discharge volume, and the space within the outer envelope is evacuated.

15 Claims, 4 Drawing Sheets

METAL HALIDE DISCHARGE LAMP WITH A QUARTZ DISCHARGE VESSEL AND AN OUTER UV RADIATION ABSORBENT ENVELOPE

FIELD OF THE INVENTION

The invention relates to methal halide discharge lamps with a sodium containing ionizable fill.

BACKGROUND

Metal halide lamps have long life and light of high quality and are therefore suitable for indoor illumination, for example, of entrance halls and salesrooms and for residential lighting. They have a warm white to neutral white color, that is, a color temperature of about 2500 to 5000 Kelvin which is obtained by a sodium additive in the ionizable fill. A technical problem observed with all sodium containing high-pressure discharge lamps is the occurrence of loss of sodium from the ionizable fill in the discharge vessel, caused by diffusion of the sodium ions through the wall of the discharge vessel. This problem is particularly acute with metal halide lamps of low power rating whose ionizable fill has a low sodium content, and with metal halide lamps operated at unsaturated sodium vapor pressure. The loss of sodium from the fill in the discharge vessel causes a change in the color temperature, increases the ignition voltage and, finally, leads to premature failure of the lamps.

The European Patent Application EP 0 464 083 discloses a lamp as described above. To avoid loss of sodium, the lamp also has an outer envelope of low thermal loading which consists of highly pure quartz glass of low electrical conductivity. A disadvantage of this solution is that a comparatively expensive raw material is required for the outer envelope in order to avoid loss of sodium. Also, the desired low thermal loading of the, outer envelope requires relatively large spacing of the outer envelope from the discharge vessel. This increases the outer dimensions of the lamp and may lead to problems when fitting the lamps into the fixtures intended therefor.

The U.S. Pat. No. 5,111,104 describes a metal halide lamp having a color temperature of about 3600 Kelvin and a luminous efficacy of about 90 lm/W. Its discharge vessel is surrounded by an evacuated outer envelope to avoid loss of sodium from the fill in the discharge vessel. The outer envelope, in turn, is surrounded by a gas-tightly closed second outer envelope filled with inert gas. The second outer envelope, however, increases the manufacture costs of the lamp.

The U.S. Pat. No. 5,196,759 discloses a lamp comprising a light source which emits UV and visible light radiation. The light source is surrounded by a UV-absorbing and visible light transmissive fused quartz envelope codoped with titanium dioxide and cerium oxide to absorb at least a portion of said UV radiation and wherein said envelope is at a temperature above 500° C. during operation of the lamp. The dopants of the quartz envelope suppress the harmful portion of the UV-radiation generated by the light source.

The U.S. Pat. No. 3,662,203 describes a high pressure metal vapor discharge lamp with saturated vapor in operating condition of the lamp comprising a discharge vessel and a double ended cylindrical outer envelope both of thermally highly loadable material permitting an operating temperature exceeding 500° C. The spacing between the inner diameter of the outer envelope and the outer diameter of the discharge vessel is defined by a ratio of from 3:1 to 1.05:1 to provide additional heating of the discharge vessel by heat which is generated by the discharge and partially reflected by the outer envelope.

THE INVENTION

It is the object of the invention to provide a metal halide lamp of the type described which has a longer life and sufficiently constant operating parameters and quality of light over the life of the lamp.

Briefly, the sodium loss from the ionizable fill in the discharge vessel is reduced, in accordance with the invention, by providing the metal halide lamps with an outer envelope of quartz glass comprising a UV doping material in the material of the outer envelope can be seen from the curves of FIGS. 3 and 4.

FIG. 3 shows the lamp operating voltage (in volts) plotted above the time of operation of the lamp (in hours). Curve 1 shows the characteristic of the lamp operating voltage with increasing time of operation for a prior art 150 W metal halide lamp with an outer envelope without UV radiation absorbing doping material. Curve 2 shows the change of the lamp operating voltage as a function of the time of operation for a metal halide lamp of the invention in accordance with the second embodiment in which the glass of the outer envelope comprises a UV radiation absorbing doping material. Curve 1 shows a steeper rise of the lamp operating voltage as the time of operation increases than curve 2. The operating voltage of a prior art metal halide lamp in accordance with curve 1 has risen from an initial 80 V to 120 V after 4000 hours of operation, whereas the operating voltage of the metal halide lamp of the invention in the same period has risen to only 110 V. The rise in lamp operating voltage with increasing time of operation or increasing age of the lamp is taken to be the result of sodium loss from the fill in the discharge vessel caused by migration of sodium ions. This assumption is supported by the curves shown in FIG. 4 which illustrate the change in color temperature with increasing time of operation of the lamps. After about 4000 hours of operation of the prior art metal halide lamps (curve 1), the color temperature shifted from an initial 4500 Kelvin to about 5500 Kelvin, that is, the long-wave red and yellow proportions of the lamp emmission spectrum are weakened, compared to the blue proportion of the emission spectrum, due to the sodium loss from the fill in the discharge vessel. With the metal halide lamp of the invention (curve 2), however, the color temperature remains nearly constant over the same period.

These measurements were carried out with several test lamps in which the glass of the outer envelope was undoped or contained a UV radiation absorbing doping material.

FIG. 5 shows a comparison of the mortality behavior of the metal halide lamps of the invention and of prior art test lamps. From this figure (curve 1) it can be seen that, with prior art metal halide lamps after about 4000 hours of operation 50% of the tested lamps were no longer operable, that is, the life time of these metal halide lamps was about 4000 hours of operation. In contrast, the metal halide lamps of the invention did not exhibit a single failure of a lamp even after 4500 hours of operation. Based on the lamp operating voltage characteristic shown in FIG. 3, lamp failures of metal halide lamps of the invention are expected only after about 6000 hours of operation, signifying an increase in lamp life by at least 50%.

The long lamp life of the metal halide lamps of the invention may presumably be explained by a reduced photoelectron emission from the current supply wires extending within the outer envelope. The UV radiation emitted from the discharge vessel, in prior art lamps, is partially reflected from the wall of the outer envelope and releases photoelectrons when impinging on the current supply wires extending within the outer envelope. A further portion of the UV radiation penetrates into the wall of the outer envelope, is partially reflected back from the outer surface of the outer envelope into the interior of the lamp, and also contributes to the photo-ionisation at the current supply wires. This last mentioned portion of the UV radiation is substantially reduced in the metal halide lamps of the invention by the UV radiation absorbing material used with the glass of the outer envelope so that the photo-ionization at the current supply wires which promote the migration of sodium is reduced.

The doping materials used preferably are compounds of cerium and/or titanium, particularly cerium aluminate and/or titanium oxide which influence only slightly the transmission of the outer envelope in the spectral region of the visible light. Only quartz glass is suitable as a material for the outer envelope for thermally highly loaded lamps where the outer envelope surrounds the discharge vessel relatively closely. The doping materials have a weight proportion in the quartz glass of the outer envelope of at most 2%, in order to avoid a significant reduction of the softening point of the doped quartz glass. The outer envelope is preferably evacuated to ensure satisfactory thermal isolation of the discharge vessel.

The invention may be used primarily with metal halide lamps having a double-ended pinch-sealed discharge vessel which is surrounded by a double-ended outer envelope and with metal halide lamps having a single-ended pinch-sealed discharge vessel located within a single-ended outer envelope. These two lamp types do not comprise any metallic current supply elements passing alongside the discharge space at which a considerable amount of photo-ionization can occur, caused by the UV radiation generated by the discharge. With metal halide lamps having a metallic current supply element, that is, with metal halide lamps having a double-ended pinch-sealed discharge vessel inside a single-ended outer envelope, the invention also brings about an extension of lamp life, if the portion of the metallic current supply element passing alongside the discharge space is provided with an isolation means which prevents the photoelectrons from being generated which would promote the migration of sodium ions caused by the UV radiation impinging directly on the metallic current supply element.

DRAWINGS

The invention will now be more closely described by way of several preferred embodiments. The figures show:

FIG. 1 a schematic illustration of a double-ended metal halide discharge lamp of the invention in accordance with embodiments one, two and four;

FIG. 2 a schematic illustration of a single-ended metal halide discharge lamp of the invention in accordance with a third embodiment;

FIG. 3 the characteristic of the operation voltage of the lamp as a function of the time of operation of a metal halide lamp without UV radiation absorbing doping material in the glass of the outer envelope (curve 1) compared to a metal halide lamp of the invention (curve 2);

FIG. 4 the change of color temperature as a function of the time of operation of a metal halide lamp without UV radiation absorbing doping material in the glass of the outer envelope (curve 1) compared to a metal halide lamp of the invention (curve 2);

FIG. 5 the mortality curve for metal halide lamps without UV radiation absorbing doping material in the glass of the outer envelope (curve 1) compared to a metal halide lamp of the invention (curve 2);

DETAILED DESCRIPTION

Figure 1:
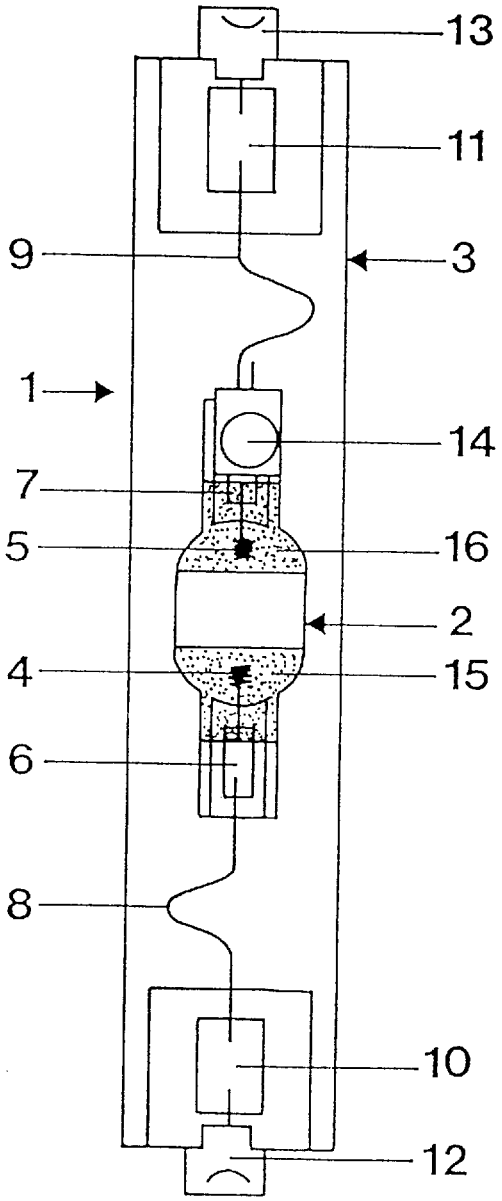

FIG. 1 shows a metal halide lamp of the invention in accordance with the first two embodiments. The lamp 1 has a double-ended pinch-sealed gas-tightly closed discharge vessel 2 of quartz glass which is surrounded by a double-ended evacuated outer envelope 3 of quartz glass. The quartz glass of the outer envelope is doped with cerium and titanium added to the quartz melt in the form of 0.51% by weight of cerium aluminate and 0.04% by weight of titanium oxide. The wall thickness of the outer envelope is approximately 1 mm. Two tungsten electrodes 4, 5 between which a gas discharge forms in operation of the lamp, are located in the interior of the discharge vessel 2. The electrodes 4, 5 are gas-tightly melt-sealed in the pinch-sealed ends of the discharge vessel 2 and are electrically connected via molybdenum foils 6, 7 to current supply wires 8, 9. The current supply wires 8, 9 are electrically connected via the molybdenum foil seals 10, 11 of the outer envelope 3 to the electrical terminals 12, 13 of the lamp 1. A getter 14 secured to one pinch-sealed end of the discharge vessel 2 is located in the interior of the outer envelope 3. The ends of the discharge vessel 2 each have a heat reflecting coating 15, 16.

The lamp of the first embodiment (FIG. 1) is a 150 W metal halide lamp. Its discharge vessel has a volume of approximately 2.5 $cm^3$. The spacing between the electrodes is about 18 mm. The spacing of the outer envelope from the discharge vessel is at most 5 mm. The ionizable fill retained in the discharge vessel consists essentially of mercury, noble gas and metal halides. The total amount of metal halides is about 5.4 mg comprising NaI (32.2% by weight),T1I (9.0% by weight) and $DyI_3$, $TmI_3$ and $HoI_3$ (each 19.6% by weight) leading to a sodium iodide amount of approximately 1.73 mg. The pure sodium content of the ionizable fill is approximately 0.10 $mg/cm^3$ discharge volume. This lamp has a neutral white light color, that is, a color temperature of about 4400 Kelvin.

The lamp of the second embodiment (FIG. 1) is a 70 W metal halide lamp. Its discharge vessel has a volume of approximately 0.7 $cm^3$. The spacing between the electrodes is about 7 mm. The ionizable fill retained in the discharge vessel consists essentially of mercury, noble gas and metal halides. The total amount of metal halides is about 2 mg comprising NaI (75.0% by weight), T1I (5.0% by weight) and $ScI_3$ (20.0% by weight). The fill comprises approximately 1.50 mg sodium iodide. The pure sodium content of the ionizable fill is approximately 0.33 $mg/cm^3$ discharge volume. This lamp has a warm white light color, that is, a color temperature of about 3000 Kelvin.

Figure 2:
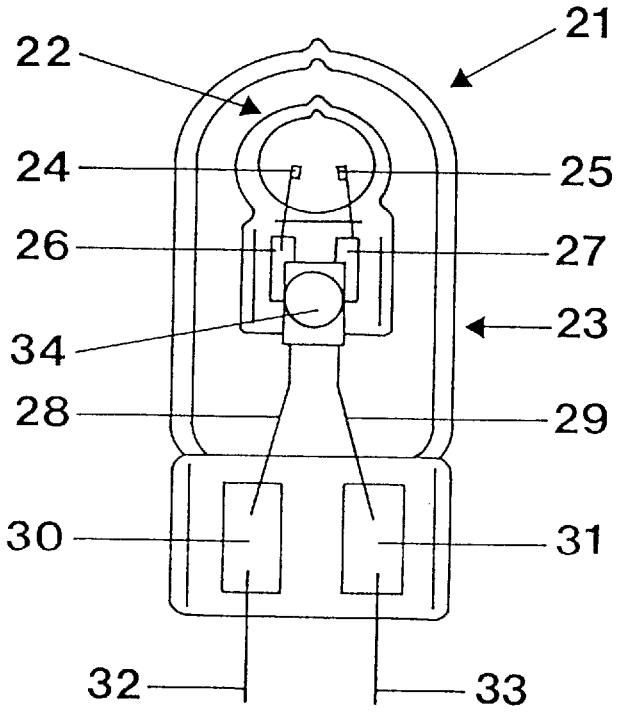
Figure 3:
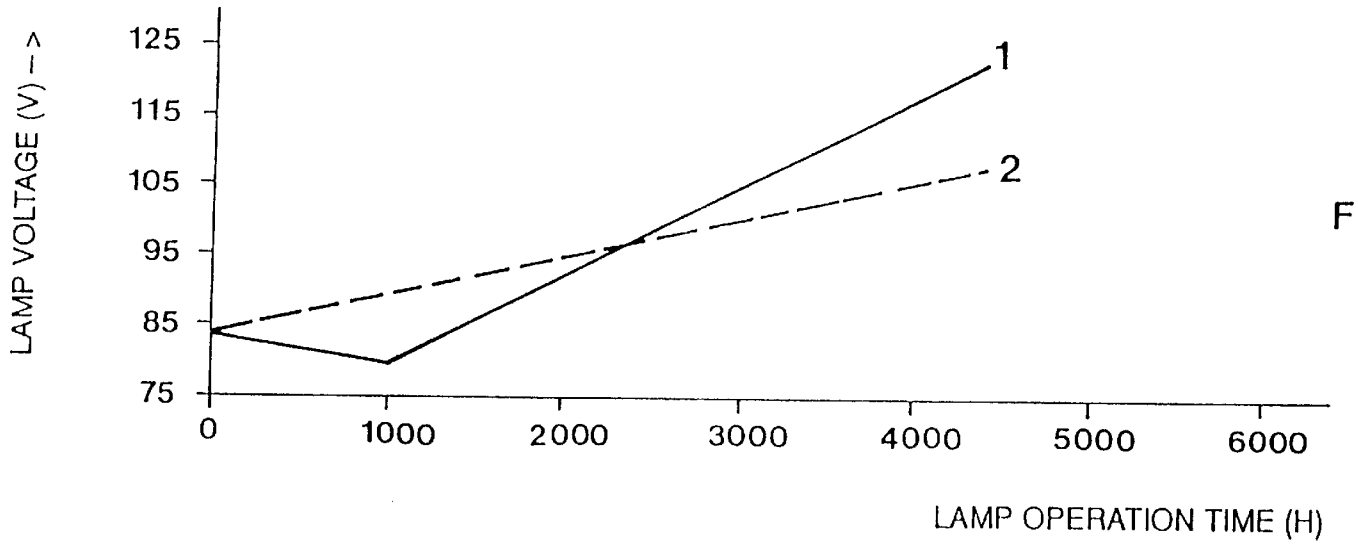
Figure 4:
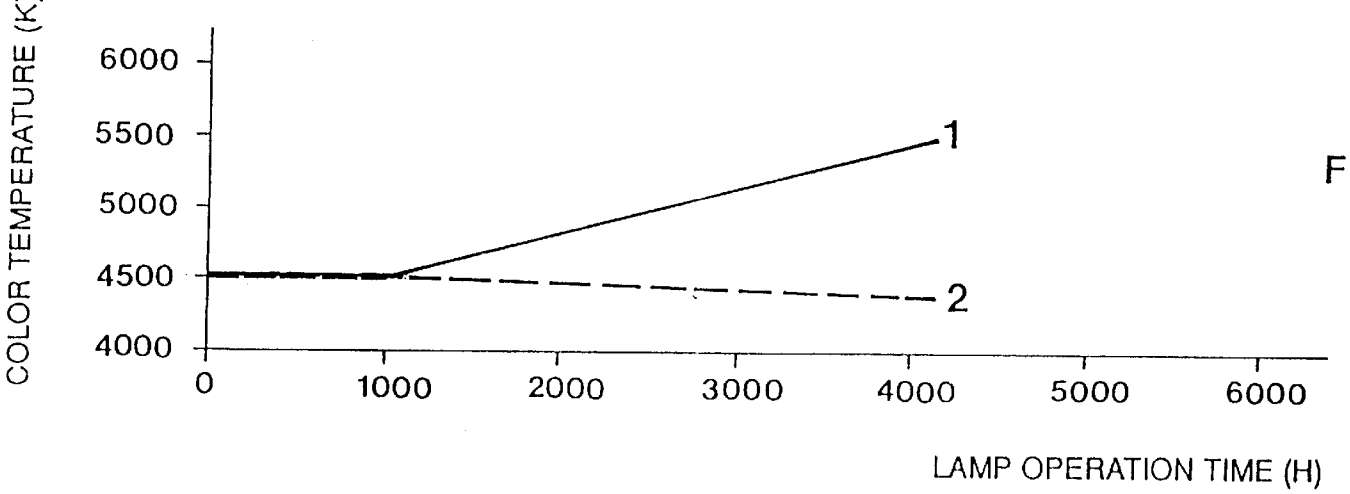
Figure 5:
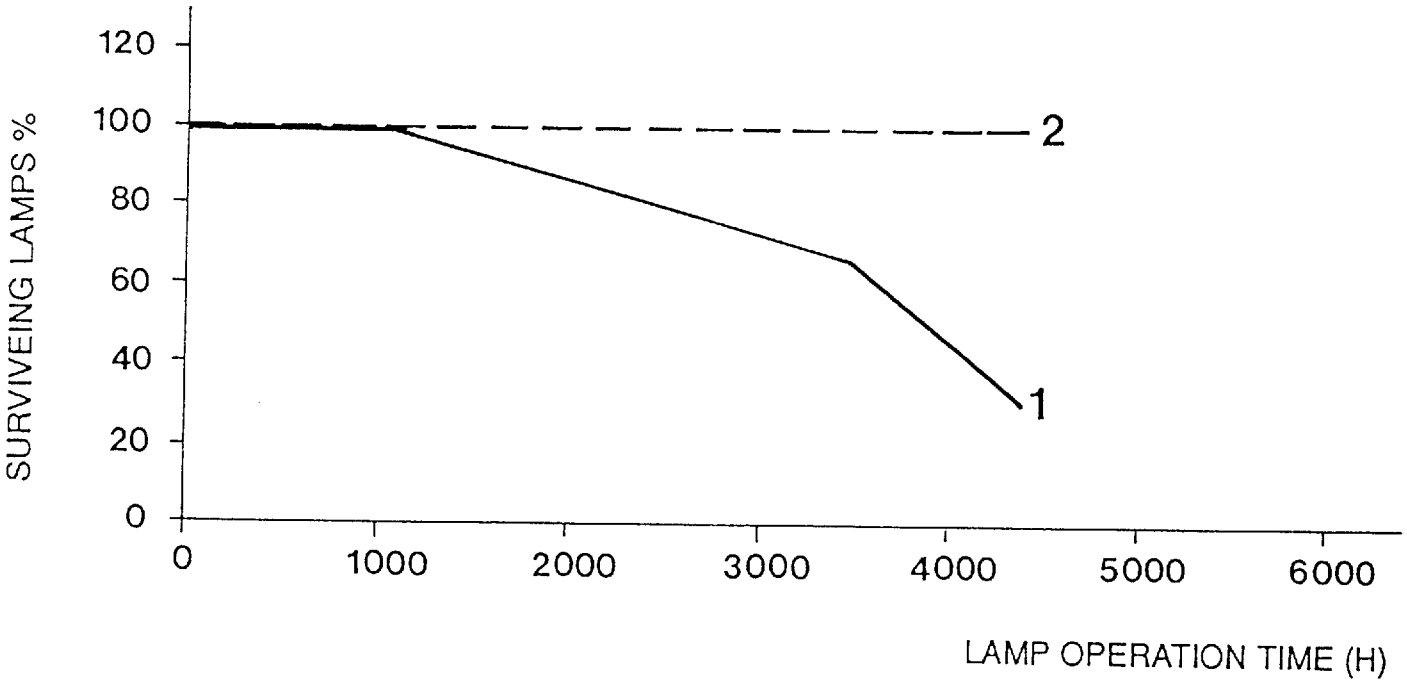

FIG. 2 shows a 70 W metal halide lamp of the invention in accordance with a third embodiment. The lamp 21 comprises a single-ended pinch-sealed discharge vessel 22 which is surrounded by a single-ended pinch-sealed outer envelope 23. The outer envelope is doped with cerium and titanium added to the quartz melt in the form of 0.51% by weight of cerium aluminate and 0.04% by weight of titanium oxide. The wall thickness of the outer envelope is approximately 1 mm. Two tungsten electrodes 24, 25 between which a gas discharge is formed in operation of the lamp are located in the interior of the discharge vessel 22. The electrodes 24, 25 are gas-tightly melt-sealed in the pinch-sealed end of the discharge vessel 22 and are electrically connected via molybdenum foils 26, 27 to the current supply wires 28, 29. The current supply wires 28, 29, in turn, are electrically connected via molybdenum foils 30, 31 in the pinched-sealed end of the outer envelope 23 to the electrical terminals 32, 33 of the lamp 21. A getter 34 secured to the pinch-sealed end of the discharge vessel 22 is located in the interior of the outer envelope 23. The discharge vessel has volume of approximately 0.3 $cm^3$. The spacing between the electrodes is about 4.5 mm. The ionizable fill retained in the discharge vessel consists essentially of mercury, noble gas and the metal halides NaI, $SnI_2$ and T1I. The total metal halide amount is approximately 0.95 mg comprising NaI (30% by weight), $SnI_2$ (63% by weight) and T1I (7% by weight). The fill comprises approximately 0.285 mg sodium iodide leading to a pure sodium content of about 0.15 $mg/cm^3$ discharge volume. This lamp has a warm white light color.

The lamp of the fourth embodiment (FIG. 1) is a 70 W metal halide lamp. Its discharge vessel has a volume of approximately 0.7 $cm^3$. The spacing between the electrodes is about 7 mm. The ionizable fill retained in the discharge vessel consists essentially of mercury, noble gas and metal halides. The total amount of the metal halides in the ionizable fill is about 4 mg. The metal halides comprise NaI (75% by weight), $ScI_3$ (20.0% by weight) and T1I (5.0% by weight) leading to a sodium iodide amount in the fill of approximately 3.0 mg. The pure sodium content of the ionizable fill is approximately 0.66 $mg/cm^3$ discharge volume. This lamp has a warm white light color.

The sodium content of the lamps is below 0.7 $mg/cm^3$ of the discharge vessel.

We claim:

1. A metal halide lamp having a discharge vessel (2, 22) made of quartz glass;

a light transmissive outer envelope (3, 23) surrounding the discharge vessel (2, 22);

electrodes (4, 5; 24, 25) in said discharge vessel;

current supply wires (8, 9; 28, 29) electrically connected to said electrodes and extending from said discharge vessel within and into said outer envelope (3, 23); and an ionizable fill which includes sodium or a sodium compound gas-tightly retained in the discharge vessel (2, 22), and including the improvement formed by a combination to reduce loss of sodium from the ionizable fill by reduction of UV radiation impinging upon said current supply wires (8, 9; 28. 29), said combination comprising the sodium content in the ionizable fill being at most 0.7 $mg/cm^3$ of the discharge volume;

said outer envelope (3, 23) consisting of quartz glass doped with a doping material which renders the quartz glass UV radiation absorbent;

the outer envelope (3, 23) being evacuated; and the spacing of the outer envelope (3, 23) from the discharge vessel (2, 22) being at most 5 mm.

2. The metal halide lamp of claim 1, characterized in that the discharge vessel (2) of the lamp is a double-ended pinch-sealed discharge vessel (2); and the outer envelope is a double-ended outer envelope (3).

3. The metal halide lamp of claim 1, characterized in that the discharge vessel (22) of the lamp is a double-ended pinch-sealed discharge vessel (22); and the outer envelope is a single-ended outer envelope (23).

4. The metal halide lamp of claim 1, characterized in that the outer envelope (3, 23) consists essentially of quartz glass doped with cerium or a cerium compound.

5. The metal halide lamp of claim 1, characterized in that the outer envelope (3, 23) consists essentially of quartz glass doped with titanium or a titanium compound.

6. The metal halide lamp of claim 5, characterized in that the quartz glass is doped with at least one of cerium aluminate and titanium oxide.

7. The metal halide lamp of claim 6, characterized in that the weight proportion of the doping material with respect to the quartz glass of the outer envelope is equal to or smaller than 2%.

8. A metal halide lamp having a discharge vessel (2, 22) made of quartz glass;

a light transmissive outer envelope (3, 23) surrounding the discharge vessel (2, 22);

electrodes (4, 5; 24, 25) in said discharge vessel;

current supply wires (8, 9; 28, 29) electrically connected to said electrodes and extending from said discharge vessel within and into said outer envelope (3, 23); and an ionizable fill which includes sodium or a sodium compound gas-tightly retained in the discharge vessel (2, 22), wherein the sodium content in the ionizable fill is at most 0.7 $mg/cm^3$ of the discharge volume;

and comprising means to reduce loss of sodium from said ionizable fill due to sodium migration resulting from photo-ionization at the current supply wires upon impingement of UV radiation on the current supply wires, said means comprising a doping material added to said outer envelope (2, 23), which doping material has the characteristics of rendering the quartz glass of said outer envelope UV radiation absorbent, whereby the UV radiation impinging on said current supply wires is attenuated;

said means further including a distance or space of the outer envelope (3, 23) from the discharge vessel (2, 22) of at most 5 mm, and the space between the outer envelope (3, 23) and said discharge vessel (2, 22) being evacuated.

9. The-metal halide lamp of claim 8, The metal halide lamp of claim 1, characterized in that the discharge vessel (2) of the lamp is a double-ended pinch-sealed discharge vessel (2); and the outer envelope is a double-ended outer envelope (3).

10. The metal halide lamp of claim 8, characterized in that the discharge vessel (22) of the lamp is a double-ended pinch-sealed discharge vessel (22); and the outer envelope is a single-ended outer envelope (23).

11. The metal halide lamp of claim 8, wherein said doping material of the outer envelope (3, 23) consists essentially of cerium or cerium compound.

12. The metal halide lamp of claim 8, wherein said doping material of the outer envelope (3, 23) consists essentially of titanium or titanium compound.

13. The metal halide lamp of claim 8, wherein said doping material of the outer envelope (3, 23) is at least one of a cerium aluminate and titanium oxide.

14. The metal halide lamp of claim 8, characterized in that the weight proportion of the doping material with respect to the quartz glass of the outer envelope (3, 23) is equal to or smaller than 2%.

15. The-metal halide lamp of claim 8, characterized in that the outer envelope (3, 23) surrounds the discharge vessel closely, without touching it.

* * * * *